US009054458B1

(12) United States Patent
Ng

(10) Patent No.: US 9,054,458 B1
(45) Date of Patent: Jun. 9, 2015

(54) CONNECTOR POSITION ASSURANCE

(71) Applicant: Yazaki North America, Inc., Canton, MI (US)

(72) Inventor: Jen Vun Ng, Westland, MI (US)

(73) Assignee: Yazaki North America, Inc., Canton, MI (US)

( * ) Notice: Subject to any disclaimer, the term of this patent is extended or adjusted under 35 U.S.C. 154(b) by 0 days.

(21) Appl. No.: 14/176,204

(22) Filed: Feb. 10, 2014

(51) Int. Cl.
*H01R 4/50* (2006.01)
*H01R 13/641* (2006.01)
*H01R 13/62* (2006.01)

(52) U.S. Cl.
CPC ..... *H01R 13/641* (2013.01); *H01R 13/62* (2013.01)

(58) Field of Classification Search
USPC ..... 439/347
See application file for complete search history.

(56) References Cited

U.S. PATENT DOCUMENTS 5,217,390 A 6/1993 Nozaki et al.
5,775,930 A 7/1998 Model et al.
5,910,027 A 6/1999 Wayt et al.
6,106,321 A 8/2000 Yoshida et al.
6,234,826 B1 5/2001 Wilber et al.
6,468,105 B2 10/2002 Noguchi et al.
6,857,892 B2 2/2005 McLauchlan et al.
7,194,915 B1 3/2007 Holcombe et al.
7,275,951 B2 * 10/2007 Shigeta et al. ..... 439/352
7,326,074 B1 2/2008 Lim et al.
7,344,406 B2 3/2008 Wolf
7,384,285 B2 6/2008 Patterson et al.
7,544,081 B2 6/2009 Lim
7,549,887 B1 6/2009 Ng et al.
7,611,365 B1 11/2009 Ng et al.
8,277,243 B1 * 10/2012 Hernandez et al. ..... 439/352
2007/0059969 A1 * 3/2007 Shamoto ..... 439/352

* cited by examiner

*Primary Examiner* — Jean F Duverne
(74) *Attorney, Agent, or Firm* — Harness, Dickey & Pierce, P.L.C.

(57) ABSTRACT

A connector assembly having a first connector housing, a second connector housing and a connector position assurance (CPA) member that is slidably mounted on the first connector housing for movement between first and second CPA positions. When the CPA member is in the first CPA position and the first connector housing is not fully mated to the second connector housing, the CPA member engages the first connector housing to inhibit sliding movement toward the second CPA position. Fully mating the first and second connector housings together unlocks the CPA member to permit it to be slid to the second CPA position to engage the second connector housing.

20 Claims, 4 Drawing Sheets

CONNECTOR POSITION ASSURANCE

FIELD

The present disclosure relates to a connector assembly having a connector position assurance feature that is independent of a housing lock.

BACKGROUND

This section provides background information related to the present disclosure which is not necessarily prior art.

Connector assemblies having connector position assurance (CPA) features are known in the art. A typical CPA feature includes a CPA lock that is movable into a final lock or "full-set" position behind a housing lock. Some CPA features can be problematic for one reason or another. Common problems with known connector assemblies having CPA features include: engagement of the CPA lock as the connector assembly is being mated so that an operator assembling the connector assembly will feel the two-step locking and mating (and possibly halt the assembly process after the first locking step); an ability to mate the connector assembly with the CPA feature is positioned in the "full-set" position; and/or an ability to un-mate the connector assembly with the CPA feature positioned in the "full-set" position.

In view of the above remarks, there remains a need in the art for an improved connector assembly having a connector position assurance feature.

SUMMARY

This section provides a general summary of the disclosure, and is not a comprehensive disclosure of its full scope or all of its features.

In one form, the present disclosure provides a connector assembly having a first connector housing, a second connector housing and a connector position assurance (CPA) member. The first connector housing has a first connector body, a housing lock tab and a CPA mount. The first connector body is configured to support a plurality of first terminals. The housing lock tab has a first end, which is fixed to the first connector body, and a second, opposite end that defines a first housing lock abutment. The CPA mount is coupled to the first connector body and defines at least one leg slot and a pair of first CPA abutments. Each of the first CPA abutments extends into the at least one leg slot. The second connector housing has a second connector body, a housing lock protrusion and a CPA control structure. The second connector body is configured to support a plurality of second terminals and defines a cavity into which the first connector housing is slidably receivable. The housing lock protrusion is coupled to the second connector body and has a second housing lock abutment that extends into the cavity. The CPA control structure is coupled to the second connector body and extends into the cavity. The CPA control structure has a pair of CPA unlocking members and a pair of second CPA abutments. The CPA member is slidably mounted to the first connector housing for movement between a first CPA position and a second CPA position. The CPA member has a CPA body, a pair of legs, and a CPA tab. Each of the legs is coupled to the CPA body and is received into the at least one leg slot. Each of the legs defines a CPA lock member and a third CPA abutment. The CPA tab is coupled to the CPA body. When the CPA member is in the first CPA position and the first connector housing is not fully mated with the second connector housing, the CPA lock members are disposed in-line with the first CPA abutments to inhibit sliding movement of the CPA member into the second CPA position. Sliding of the first connector housing into the cavity of the second connector housing to fully mate the first and second connector housings (a) engages the first and second housing lock abutments to one another to resist withdrawal of the first connector housing from the second connector housing, and (b) engages each of the CPA unlocking members to a corresponding one of the legs to move the CPA lock members out of line with the first CPA abutments to permit the CPA member to be moved into the second CPA position. Sliding of the CPA member into the second CPA position when the first and second connector housings are fully mated (a) engages the second and third CPA abutments to one another to resist sliding movement of the CPA member out of the second CPA position, and (b) positions the CPA tab between the second end of the housing lock tab and the first connector body to inhibit deflection of the second end of the housing lock tab to an extent that permits disengagement of the first and second housing lock abutments.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

FIG. 1 is an exploded top perspective view of a connector assembly constructed in accordance with the teachings of the present disclosure;

FIG. 2 an exploded bottom perspective view of the connector assembly of FIG. 1;

Corresponding reference numerals indicate corresponding parts throughout the several views of the drawings.

DETAILED DESCRIPTION

Example embodiments will now be described more fully with reference to the accompanying drawings.

Figure 1:
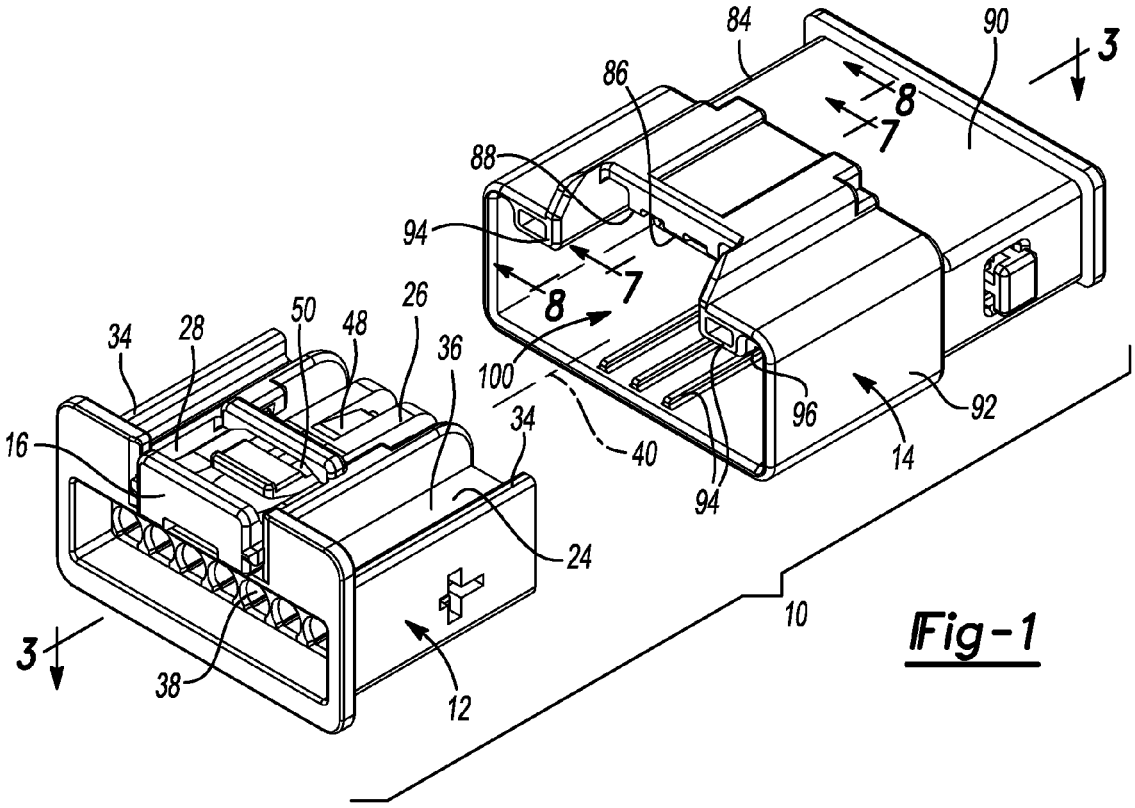
Figure 3:
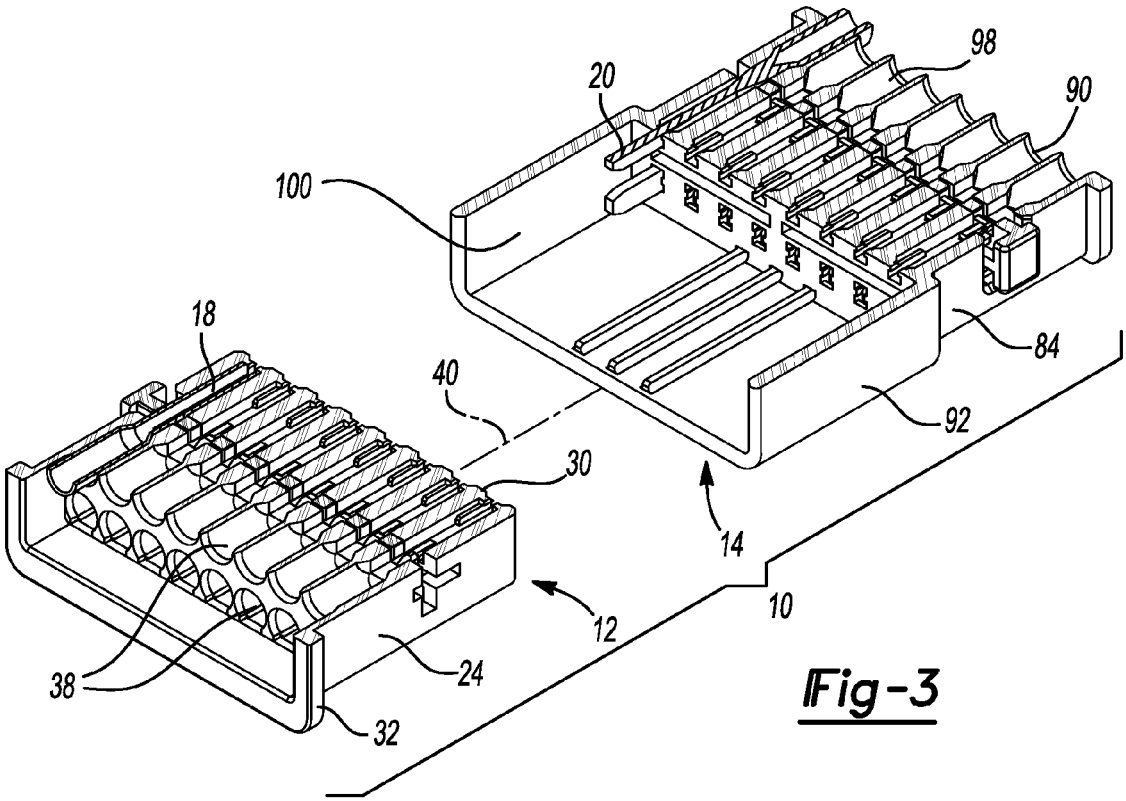
FIG. 3 is an exploded section view of portion of the connector assembly of FIG. 1.

With reference to FIG. 1 of the drawings, a connector assembly constructed in accordance with the teachings of the present disclosure is generally indicated by reference numeral 10. The connector assembly 10 can include a first connector housing 12, a second connector housing 14, a connector position assurance (CPA) member 16, a plurality of first terminals 18 (FIG. 3) and a plurality of second terminals 20 (FIG. 3).

The first connector housing 12 can have a first connector body 24, a housing lock tab 26, and a CPA mount 28. With additional reference to FIGS. 2 and 3, the first connector body 24 can include a first terminal housing 30, a rear flange 32, a plurality of first guide rails 34 and a plurality of first guide slots 36. The first terminal housing 30 can define a plurality of first terminal apertures 38 that are configured to slidably receive and engage a corresponding one of the first terminals 18 such that the first connector housing 12 supports the first terminals 18. The rear flange 32 can be coupled to a rear end of the first terminal housing 30 and can extend outwardly from each of the sides of the first terminal housing 30. The first guide rails 34 and the first guide slots 36 can be positioned on the first terminal housing 30 in desired areas and can extend generally parallel to an insertion axis 40 that will be discussed in more detail, below.

Figure 4:
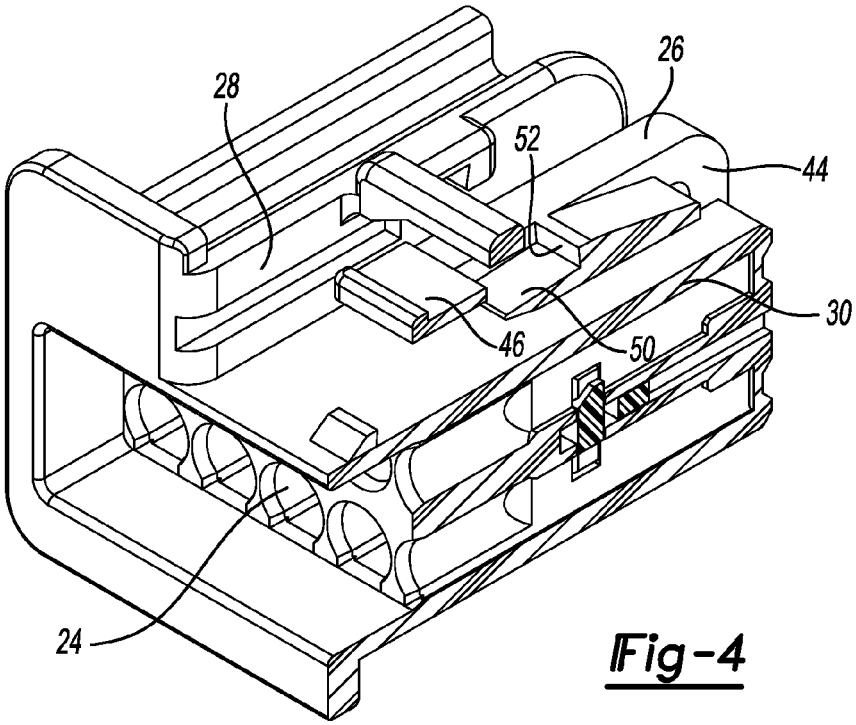
FIG. 4 is a section view taken through a portion of the connector assembly of FIG. 1 illustrating a housing lock tab on a first connector housing.

With reference to FIGS. 1 and 4, the housing lock tab 26 can have a first end 44, which can be coupled to the first connector body 24 at a desired location, such as a front end of the first terminal housing 30, and can have a second end 46 that can be deflectable relative to the first connector body 24. In the particular example provided, the housing lock tab 26 is generally L-shaped. The second end 46 of the housing lock tab 26 can define a housing lock ramp 48 and a housing lock recess 50. An edge of the housing lock recess 50 can define a first housing lock abutment 52.

Figure 5:
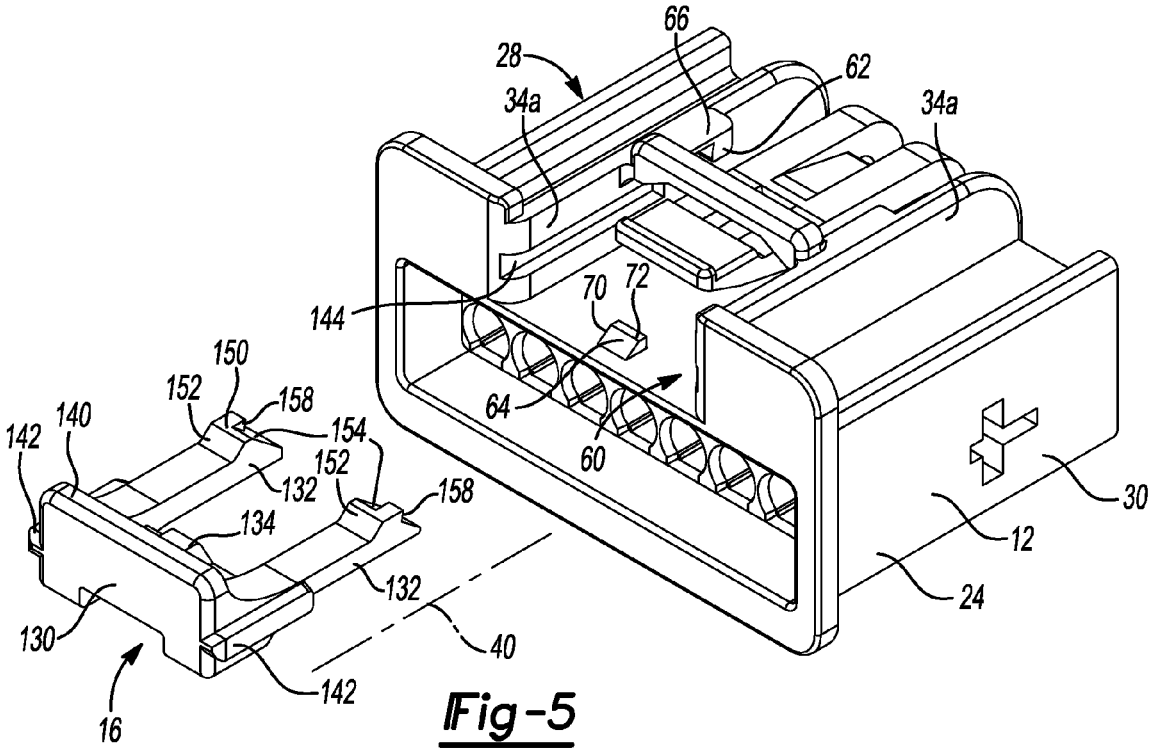
FIG. 5 is an exploded perspective view of a portion of the connector assembly of FIG. 1 illustrating a connector position assurance (CPA) member exploded from the first connector housing.
Figure 6:
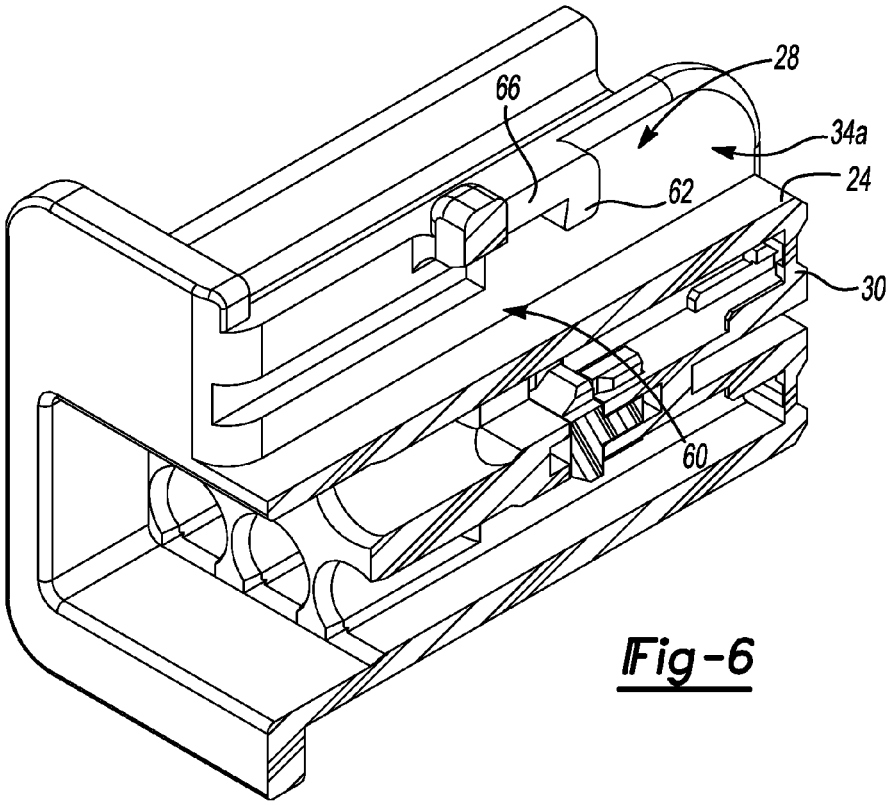
FIG. 6 is a section view taken through a portion of the connector assembly of FIG. 1 illustrating a portion of a CPA mount on the first connector housing in more detail.

With reference to FIGS. 5 and 6, the CPA mount 28 can be coupled to the first connector body 24 and can define at least one leg slot 60, a pair of first CPA abutments 62, and a CPA lock protrusion 64. The at least one leg slot 60 can extend in a direction parallel to the insertion axis 40. In the particular example provided, the at least one leg slot 60 comprises a single slot that is defined by two guide rails 34*a* that are disposed on opposite lateral sides of the CPA mount 28. Each of the first CPA abutments 62 can be coupled an associated one of the guide rails 34*a* and can extend into the leg slot 60. Each of the first CPA abutments 62 can be co-formed with a rib 66 that is fixed to a side of an associated one of the guide rails 34*a* on a side opposite the first terminal housing 30 of the first connector body 24. Each of the first CPA abutments 62 can be a planar surface formed on a corresponding one of the ribs 66 that extends generally perpendicular to the insertion axis 40. The CPA lock protrusion 64 can be coupled to the first connector body 24 and can extend upwardly therefrom. The CPA lock protrusion 64 can have a rear-facing ramp portion 70 and a front facing abutment surface 72.

Figure 2:
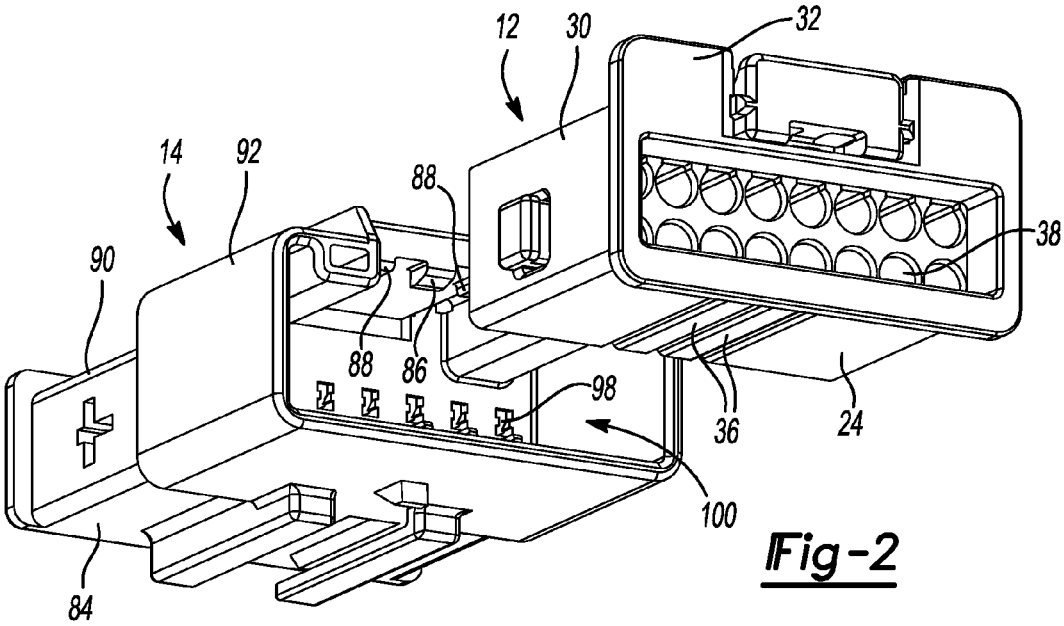
Figure 7:
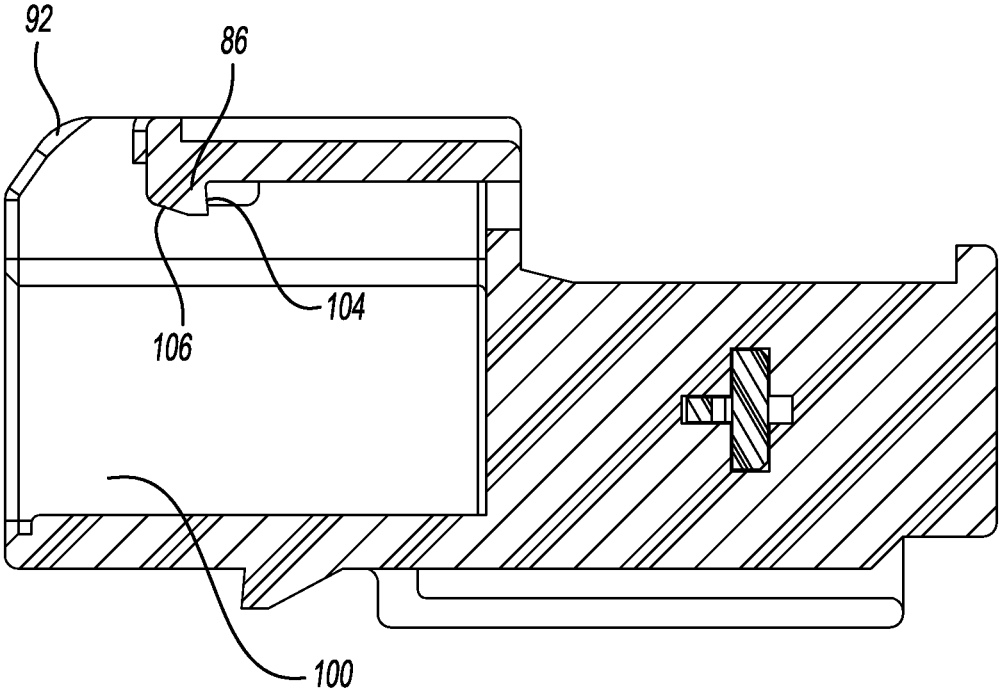
FIG. 7 is a section view taken through a portion of the connector assembly of FIG. 1 illustrating a housing lock protrusion on a second connector housing.
Figure 8:
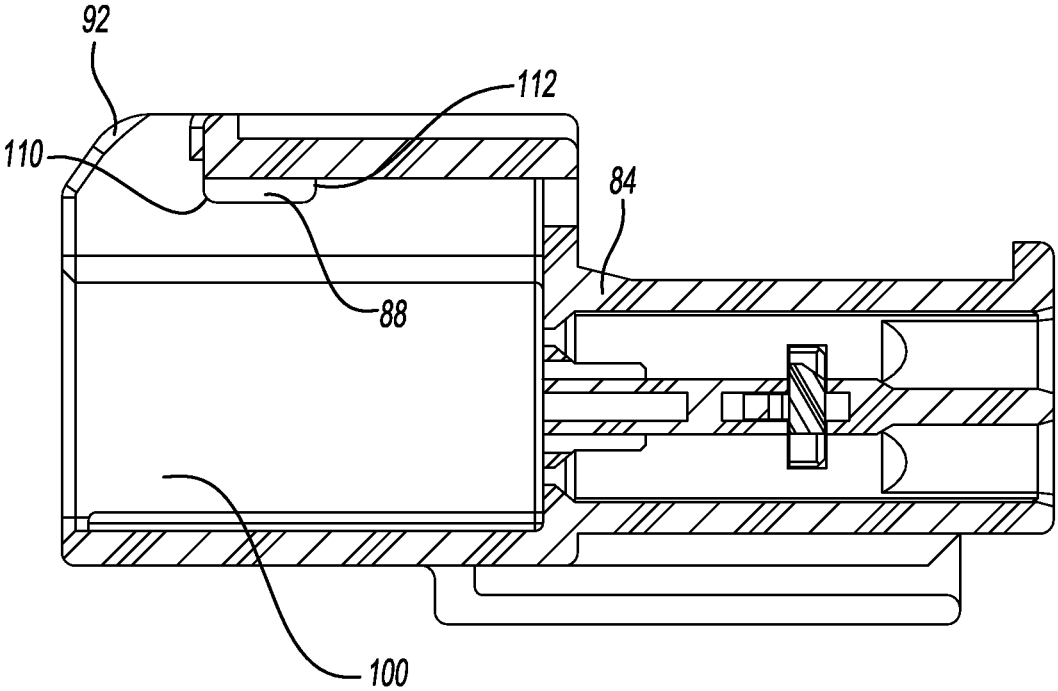
FIG. 8 is a section view taken through a portion of the connector assembly of FIG. 1 illustrating a portion of a CPA control structure on the second connector housing.

With reference to FIGS. 1 through 3, the second connector housing 14 can include a second connector body 84, a housing lock protrusion 86 (best shown in FIG. 7) and a CPA control structure 88 (best shown in FIG. 8). The second connector body 84 can include a second terminal housing 90, a shroud member 92, a plurality of second guide rails 94 and a plurality of second guide slots 96. The second terminal housing 90 can define a plurality of second terminal apertures 98 that are configured to slidably receive and engage a corresponding one of the second terminals 20 such that the second connector housing 14 supports the first terminals 18. The shroud member 92 can be coupled to a front end of the second terminal housing 90 and can define a cavity 100 into which the first terminal housing 30 can be slidably received (along the insertion axis 40) to thereby fixedly and electrically couple the first terminals 18 to the second terminals 20. The shroud member 92 can shroud a portion of the second terminals 20 that extends from the second terminal housing 90 when the first and second connector housings 12 and 14 are decoupled from one another. The second guide rails 94 and the second guide slots 96 can extend generally parallel to the insertion axis 40 and are configured to cooperate with the first guide slots 36 and the first guide rails 34, respectively, to align the first and second connector housings 12 and 14 to one another as the first connector housing 12 is moved along the insertion axis 40 to insert the first connector housing 12 into the second connector housing 14.

With specific reference to FIG. 7, the housing lock protrusion 86 can be coupled to the shroud member 92 and can define a second housing lock abutment 104 that can extend into the cavity 100. A ramp 106 can be formed on an opposite side of the housing lock protrusion 86.

In FIGS. 2 and 8, the CPA control structure 88 can be coupled to the second connector body 84 (e.g., the shroud member 92) and can extend into the cavity 100. The CPA control structure 88 can define a pair of CPA unlocking members 110 and a pair of second CPA abutments 112. Each of the CPA unlocking members 110 can be paired to one of the second CPA abutments 112 and can be positioned on a lateral side of the housing lock protrusion 86.

With reference to FIG. 5, the CPA member 16 can be slidably mounted to the first connector housing 12 (e.g., the CPA mount 28) for movement parallel to the insertion axis 40 between a first CPA position and a second CPA position. The CPA member 16 can have a CPA body 130, one or more legs 132, and a CPA tab 134. The CPA body 130 can include a CPA flange 140 and a pair of CPA guide rails 142. The CPA flange 140 can be disposed generally perpendicular to the insertion axis 40. The CPA guide rails 142 can be coupled to the CPA flange 140 and can be received into CPA guide slots 144 formed in the CPA mount 28 such that the CPA guide rails 142 extend generally parallel to the insertion axis 40. It will be appreciated, however, that in the alternative, the CPA guide rails 142 could be formed in the CPA mount 28 and that the CPA guide slots 144 could be formed in the CPA body 130. Each of the legs 132 can be coupled to the CPA body 130 and can be received into the at least one leg slot 60 formed in the CPA mount 28. Each of the legs 132 can define a CPA lock member 150, a third CPA abutment 152, and a CPA ramp 154. Each CPA lock member 150 can be co-formed with an associated one of the CPA ramps 154 and can have a lock member surface 158 that extends generally perpendicular to the insertion axis 40. The CPA lock members 150 are configured to cooperate with the first CPA abutments 62 when the CPA member 16 is in the first CPA position and the first connector housing 12 is decoupled from the second connector housing 14 such that the lock member surfaces 158 engage the planar surfaces on the first CPA abutments 62 to inhibit movement of the CPA member 16 relative to the first connector housing 12 in a direction parallel to the insertion axis 40. In this regard, engagement of the CPA lock members 150 to the first CPA abutments 62 can inhibit sliding motion of the CPA member 16 toward the second CPA position and/or out of the first CPA position. The third CPA abutment 152 can be disposed on the leg 132 between the CPA lock member 150 and the CPA body 130 and can extend generally perpendicular to the insertion axis 40. The CPA ramp 154 can extend forwardly from the third CPA abutment 152 and can taper away from the rib 66 in a manner that increases with increasing distance from the CPA body 130. The CPA tab 134 can be coupled to the CPA body 130 between the legs 132.

With reference to FIGS. 1, 5 and 6, when the CPA member 16 is in the first CPA position and the first connector housing 12 is not fully mated with the second connector housing 14, the CPA lock members 150 are disposed in-line with the first CPA abutments 62 to inhibit sliding movement of the CPA member 16 into the second CPA position.

Sliding of the first connector housing 12 along the insertion axis 40 into the cavity 100 of the second connector housing 14 to fully mate the first and second connector housings 12 and 14 (*i*) engages the first housing lock abutment 52 (FIG. 4) with the second housing lock abutment 104 (FIG. 7) to resist withdrawal of the first connector housing 12 from the second connector housing 14, and (ii) engages each of the CPA unlocking members 110 (FIG. 8) to a corresponding one of the legs 132 to move the CPA lock members 150 out of line with the first CPA abutments 62 to permit the CPA member 16 to be moved into the second CPA position. It will be appreciated that mating of the first connector housing 12 to the second connector housing 14 causes the housing lock protrusion 86 to engage the housing lock ramp 48 to deflect the second end 46 of the housing lock tab 26 to permit the housing lock protrusion 86 to be received into the housing lock recess 50 when the first connector housing 12 is fully mated to the second connector housing 14 such that the second housing lock abutment 104 on the housing lock protrusion 86 engages or abuts the first housing lock abutment 52 to inhibit the withdrawal of the first connector housing 12 from the second connector housing 14. It will also be appreciated that engagement of the CPA unlocking members 110 to a corresponding one of the legs 132 can entail contact between the CPA unlocking members 110 and the CPA ramps 154 that can deflect the distal ends of the legs 132 such that the CPA lock members 150 are moved out of line with the first CPA abutments 62.

Sliding of the CPA member 16 parallel to the insertion axis 40 into the second CPA position when the first and second connector housings 12 and 14 are fully mated (a) engages the second CPA abutment 112 (FIG. 8) and the third CPA abutment 152 together to resist sliding movement of the CPA member 16 out of the second CPA position, and (b) positions the CPA tab 134 between the second end 46 of the housing lock tab 26 and the first connector body 24 to inhibit deflection of the second end 46 of the housing lock tab 26 to an extent that permits disengagement of the first and second housing lock abutments 52 and 104 (FIGS. 4 and 7) so that the first and second connector housings 12 and 14 cannot be moved apart from one another in a manner that would unmate the first and second connector housings 12 and 14 from one another.

Configuration of the connector assembly 10 in this manner can inhibit movement of the CPA member 16 into the second CPA position before the first and second connector housings 12 and 14 are fully mated to one another. In this regard, deflected housing lock tab 26 will contact the CPA member 16 and prevent the CPA member 16 from being moved to the second CPA position, thereby alerting an assembly technician that the first and second connector housings 12 and 14 are only partially mated. Moreover, the assembly technician can press on the CPA member 16 to cause push the first connector housing 12 into engagement with the second connector housing 14 (i.e., to fully mate the first and second connector housings 12 and 14) and thereafter move the CPA member 16 into the second CPA position.

Configuration of the connector assembly 10 in this manner can cause the connector assembly 10 to produce a single "click" to denote the engagement of the first and second connector housings 12 and 14 (i.e., the CPA lock member 150 and the first CPA abutment 62 can be configured such that the unlocking of the CPA member 16 from the CPA mount 28 does not produce an audible "click") and/or can inhibit the decoupling of the first connector housing 12 from the second connector housing 14 when the CPA member 16 is in the second CPA position despite the application of a relatively high decoupling force to the first and second connector housings 12 and 14. Accordingly, it will be appreciated that the physical separation of the CPA control structure 88 (FIG. 2) and the housing lock protrusion 86 (FIG. 2) renders the locking of the CPA member 16 independent of the locking of the first and second connector housings 12 and 14, which can permit the connector assembly 10 to be packaged into a lower-profile volume as compared with a CPA that utilizes a single lock that rides on the housing lock, as well as provide a relatively stronger (locking) connection between the first and second connector housings 12 and 14 that results from the use of two independent locks. Additionally, damage to the housing lock (i.e., housing lock protrusion 86 (FIG. 2) and the housing lock tab 26 (FIG. 4) will not affect the performance of the CPA lock (i.e., the CPA member 16 and the CPA control structure 88 (FIG. 2)).

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A connector assembly comprising:

a first connector housing having a first connector body, a housing lock tab and a connector position assurance (CPA) mount, the first connector body being adapted to support a plurality of first terminals, the housing lock tab having a first end, which is fixed to the first connector body, and a second, opposite end that defines a first housing lock abutment, the CPA mount being coupled to the first connector body and defining at least one leg slot and a pair of first CPA abutments, each of the first CPA abutments extending into the at least one leg slot;

a second connector housing having a second connector body, a housing lock protrusion and a CPA control structure, the second connector body being adapted to support a plurality of second terminals and defining a cavity into which the first connector housing is slidably receivable, the housing lock protrusion being coupled to the second connector body and having a second housing lock abutment that extends into the cavity, the CPA control structure being coupled to the second connector body and extending into the cavity, the CPA control structure having a pair of CPA unlocking members and a pair of second CPA abutments; and a CPA member that is slidably mounted to the first connector housing for movement between a first CPA position and a second CPA position, the CPA member having a CPA body, a pair of legs, and a CPA tab, each of the legs being coupled to the CPA body and being received into the at least one leg slot, each of the legs defining a CPA lock member and a third CPA abutment, the CPA tab being coupled to the CPA body;

wherein when the CPA member is in the first CPA position and the first connector housing is not fully mated with the second connector housing, the CPA lock members are disposed in-line with the first CPA abutments to inhibit sliding movement of the CPA member into the second CPA position;

wherein sliding of the first connector housing into the cavity of the second connector housing to fully mate the first and second connector housings (a) engages the first and second housing lock abutments to one another to resist withdrawal of the first connector housing from the second connector housing, and (b) engages each of the CPA unlocking members to a corresponding one of the legs to move the CPA lock members out of line with the first CPA abutments to permit the CPA member to be moved into the second CPA position; and wherein sliding of the CPA member into the second CPA position when the first and second connector housings are fully mated (a) engages the second and third CPA abutments to one another to resist sliding movement of the CPA member out of the second CPA position, and (b) positions the CPA tab between the second end of the housing lock tab and the first connector body to inhibit deflection of the second end of the housing lock tab to an extent that permits disengagement of the first and second housing lock abutments.

2. The connector assembly of claim 1, wherein when the CPA member is in the first CPA position and the first and second connector housings are not fully mated together, engagement of the CPA lock member with the first CPA abutment inhibits sliding movement of the CPA member out of the first CPA position.

3. The connector assembly of claim 1, wherein each leg has a CPA ramp that is engaged by a corresponding one of the CPA unlocking structures when the CPA member is in the first CPA position and the first and second connector housings are fully mated together.

4. The connector assembly of claim 3, wherein each of the CPA lock members is formed on a corresponding one of the CPA ramps.

5. The connector assembly of claim 1, wherein the housing lock tab defines a housing lock recess and wherein an edge of the housing lock recess defines the first housing lock abutment.

6. The connector assembly of claim 5, wherein the housing lock tab defines a housing lock ramp and wherein the housing lock protrusion cooperates with the housing lock ramp to coordinate deflection of the second end of the housing lock tab.

7. The connector assembly of claim 1, wherein one of the CPA mount and the CPA member defines a plurality of guide rails and wherein the other one of the CPA mount and the CPA member defines a plurality of guide slots into which the guide rails are slidably received.

8. The connector assembly of claim 1, wherein one of the first and second connector bodies defines a plurality of guide rails and wherein the other one of the first and second connector bodies defines a plurality of guide slots into which the guide rails are slidably received when the first and second connector housings are in the fully mated position.

9. The connector assembly of claim 1, wherein the CPA mount comprises a CPA lock protrusion that inhibits movement of the CPA structure out of the first CPA position in a direction opposite the second CPA position.

10. The connector assembly of claim 1, wherein the at least one leg slot has an outboard side that is defined by a wall member and wherein a rib is coupled to each wall member to bound a side of the at least one leg slot and wherein the first CPA abutments are formed on the ribs.

11. A connector assembly comprising:

a first connector housing having a first connector body, a housing lock tab and a connector position assurance (CPA) mount, the first connector body being adapted to support a plurality of first terminals, the housing lock tab having a first end, which is fixed to the first connector body, and a second, opposite end that defines a first housing lock abutment, the CPA mount being coupled to the first connector body and defining a leg slot and a first CPA abutment, the first CPA abutment extending into the leg slot;

a second connector housing having a second connector body, a housing lock protrusion and a CPA control structure, the second connector body being adapted to support a plurality of second terminals and defining a cavity into which the first connector housing is slidably receivable, the housing lock protrusion being coupled to the second connector body and having a second housing lock abutment that extends into the cavity, the CPA control structure being coupled to the second connector body and extending into the cavity, the CPA control structure having a CPA unlocking member and a second CPA abutment; and a CPA member that is slidably mounted to the first connector housing for movement between a first CPA position and a second CPA position, the CPA member having a CPA body, a leg, and a CPA tab, the leg being coupled to the CPA body and being received into the leg slot, the leg defining a CPA lock member and a third CPA abutment, the CPA tab being coupled to the CPA body;

wherein when the CPA member is in the first CPA position and the first connector housing is not fully mated with the second connector housing, the CPA lock member is disposed in-line with the first CPA abutment to inhibit sliding movement of the CPA member into the second CPA position;

wherein sliding of the first connector housing into the cavity of the second connector housing to fully mate the first and second connector housings (a) engages the first and second housing lock abutments to one another to resist withdrawal of the first connector housing from the second connector housing, and (b) engages the CPA unlocking member to the leg to move the CPA lock member out of line with the first CPA abutments to permit the CPA member to be moved into the second CPA position; and wherein sliding of the CPA member into the second CPA position when the first and second connector housings are fully mated (a) engages the second and third CPA abutments to one another to resist sliding movement of the CPA member out of the second CPA position, and (b) positions the CPA tab between the second end of the housing lock tab and the first connector body to inhibit deflection of the second end of the housing lock tab to an extent that permits disengagement of the first and second housing lock abutments.

12. The connector assembly of claim 11, wherein when the CPA member is in the first CPA position and the first and second connector housings are not fully mated together, engagement of the CPA lock member with the first CPA abutment inhibits sliding movement of the CPA member out of the first CPA position.

13. The connector assembly of claim 11, wherein each leg has a CPA ramp that is engaged by a corresponding one of the CPA unlocking structures when the CPA member is in the first CPA position and the first and second connector housings are fully mated together.

14. The connector assembly of claim 13, wherein each of the CPA lock members is formed on a corresponding one of the CPA ramps.

15. The connector assembly of claim 11, wherein the housing lock tab defines a housing lock recess and wherein an edge of the housing lock recess defines the first housing lock abutment.

16. The connector assembly of claim 15, wherein the housing lock tab defines a housing lock ramp and wherein the housing lock protrusion cooperates with the housing lock ramp to coordinate deflection of the second end of the housing lock tab.

17. The connector assembly of claim 11, wherein one of the CPA mount and the CPA member defines a plurality of guide rails and wherein the other one of the CPA mount and the CPA member defines a plurality of guide slots into which the guide rails are slidably received.

18. The connector assembly of claim 11, wherein one of the first and second connector bodies defines a plurality of guide rails and wherein the other one of the first and second connector bodies defines a plurality of guide slots into which the guide rails are slidably received when the first and second connector housings are in the fully mated position.

19. The connector assembly of claim 11, wherein the CPA mount comprises a CPA lock protrusion that inhibits movement of the CPA structure out of the first CPA position in a direction opposite the second CPA position.

20. The connector assembly of claim 11, wherein the at least one leg slot has an outboard side that is defined by a wall member and wherein a rib is coupled to each wall member to bound a side of the at least one leg slot and wherein the first CPA abutments are formed on the ribs.

* * * * *